US005936482A

United States Patent [19]

Ando et al.

[11] Patent Number: 5,936,482

[45] Date of Patent: Aug. 10, 1999

[54] THREE DIMENSIONAL POLYHEDRAL-SHAPED MICROWAVE SWITCHES

[75] Inventors: Michael N. Ando, Torrance; Clinton F. Steidel, La Mirada, both of Calif.

[73] Assignee: Hughes Electronics Corporation, El Segundo, Calif.

[21] Appl. No.: 08/974,932

[22] Filed: Nov. 20, 1997

[51] Int. Cl.[6] ..... H01P 1/11

[52] U.S. Cl. ..... 333/108; 333/107; 335/5; 200/51.05

[58] Field of Search ..... 333/105, 106, 333/107, 108; 335/4, 5; 200/51.05, 504

[56] References Cited

U.S. PATENT DOCUMENTS

| | | | |
|---|---|---|---|
| 3,009,117 | 11/1961 | Lanctot | 333/108 |
| 4,070,637 | 1/1978 | Assal et al. | 333/10 |
| 4,119,931 | 10/1978 | Hudspeth et al. | 333/105 |
| 4,317,972 | 3/1982 | Kjellberg | 200/504 |
| 4,795,994 | 1/1989 | Hoffman | 335/82 |
| 4,965,542 | 10/1990 | Nelson | 335/5 |
| 5,063,364 | 11/1991 | Tsoi | 333/107 |
| 5,065,125 | 11/1991 | Thomson et al. | 335/5 |
| 5,281,936 | 1/1994 | Ciezarek | 335/4 |

FOREIGN PATENT DOCUMENTS

| | | | |
|---|---|---|---|
| 1947583 | 4/1971 | Germany | 333/105 |

OTHER PUBLICATIONS

F. Assal, C. Mahle, A. Berman, "Network topologies to enhance the reliability of communications satellites", Comsat Technical Review, vol. 6, No. 2, Fall 1976, pp. 309–322.

*Primary Examiner*—Robert Pascal
*Assistant Examiner*—Justin P. Bettendorf
*Attorney, Agent, or Firm*—Georgann S. Grunebach; M. W. Sales

[57] ABSTRACT

A 3D microwave switch having a plurality of waveguide transmission lines configured in a polyhedron and with I/O microwave ports at the corners. An actuator selectively moves respective reeds in the waveguide transmission lines between a signal-attenuating position abutting the interior surface of the waveguide transmission line and a signal-conducting position substantially coaxial with the waveguide transmission line and abutting the signal lines of the I/O microwave ports coupled to opposite ends of the waveguide transmission line. Preferably, the transmission lines and ports are formed in a tetrahedral-shaped conductive cavity with a single 4-pole magnet at its center for actuating the reeds or in an octahedral-shape with different actuators for each reed.

27 Claims, 6 Drawing Sheets

| STATE | DIAGRAM | PORT CONNECTIONS |
|---|---|---|
| 1 |  | 1−2<br>3−4 |
| 2 |  | 1−3<br>2−4 |
| 3 |  | 1−4<br>2−3 |

THREE DIMENSIONAL POLYHEDRAL-SHAPED MICROWAVE SWITCHES

BACKGROUND OF THE INVENTION

1. Field of the Invention

This invention relates to microwave switches and more specifically to three dimensional (3D) microwave switches, particularly tetrahedral or octahedral shaped T-switches, for routing microwave signals along selectable signal paths between a plurality of switch ports.

2. Description of the Related Art

Microwave switches are used in redundant switching networks on board spacecraft to route M input signals to M outputs through N (N>M) failure-prone devices such as traveling wave tube amplifiers (TWTAS) to significantly enhance the networks' end-of-life reliability. This is accomplished using two layers of microwave switches, with each layer including M serial connected 4-port switches, for example, T-switches. The switches in the input layer are controlled to route the M input signals around the failed devices and through functioning devices. The switches in the output layer are controlled to route the signals produced by the M selected devices to the M outputs.

U.S. Pat. Nos. 4,070,637, 4,317,972, 5,063,364, 5,065,125 and 5,281,936 to Assal et al., Kjelbert, Tsoi, Thomson et al. and Cierzarek, respectively, show a known T-switch arrangement in which one of the ports is surrounded by the other three, and six microwave paths selectively interconnect the ports in a common plane. The T-switch has three different states, in which opposing pairs of the microwave paths are switched to a signal-conducting position to couple two pairs of ports while the remaining four paths are switched to a signal-attenuating position. Specifically, in the first state ports 1 and 2 are connected and ports 3 and 4 are connected. In the second state, ports 1 and 3 are connected and ports 2 and 4 are connected. In the third state, ports 1 and 4 are connected and ports 2 and 3 are connected. The multistate T-switch provides the flexibility required to reroute microwave signals in a redundant switching network.

In the known T-switches, the ports are typically coaxial connectors having outer shields that are grounded to an RF cavity and center conductors that are inserted into the cavity. The cavity is constructed with six waveguides that lie in the common plane between the connectors' center conductors. Each of the waveguides contains a conductive reed which is moved by an actuator between a signal-attenuating position abutting the waveguide's interior surface and a signal-conducting position coaxial with the waveguide and abutting the ends of the center conductors at each end of the waveguide. Because the microwave paths lie in a common plane, it is relatively simple to machine the cavity to align the coaxial connector' center conductors over the ends of the reeds and to control their height so that the reeds make proper contact.

The T-switches use a variety of different actuators to move the reeds. One conventional actuator includes a pivotable armature that pivots about the end of a permanent magnetic in response to pulses applied to a pair of electromagnetics. One end of the actuator moves a reed via a dielectric post. Tsoi uses a circularly shaped actuator that has one or more ridges and one or more indentations. When the actuator is rotated, the ridges depress a pair of reeds contacting them between the center conductors and the indentations release the remaining spring-loaded reeds so that they abut the waveguide's interior surface. Thomson et al. includes a rotatable armature that is driven by a stepper motor. The rotatable armature carries a plurality of permanent magnets which have predetermined polarities and each reed carries a permanent magnet. The reeds are selectively positioned in the waveguide by rotating the armature to place a permanent magnet adjacent the reed magnet to either attract or repel the reed. Cierzarek employs three cantilever leaf spring actuators, which are respectively displaced by the rocking action of a wobble plate caused by the repelling and attraction forced provided by a series of spaced magnetic coils. Rocking of the wobble plate to one of three selected positions displaces a particular leaf spring which in turn depresses a pair of selected reeds into bridging contact with the center conductors.

Although the known planar T-switch configurations are used effectively in redundant switching networks on board spacecraft, there are a number of aspects that bear improvement. A typical spacecraft may employ several hundred microwave switches so that a small reduction in the weight of each switch can amount to a significant cost savings. The actuators are the primary weight components of the switches, and thus a switch topology that would facilitate a simpler and lighter weight actuator is highly desirable. Second, in the planar topology the three inner and outer waveguides necessarily have different lengths. As a result, the signal paths through different ports have different microwave properties, which prohibits the overall system from being optimized. Third, the ends of the center conductors are flared substantially to ensure contact to the underlying conductive reeds. This limits the high frequency performance of the switch. Fourth, the physical access to the coaxial connectors is limited. Lastly, as the complexity of the redundant switching networks increases, it will be very difficult to develop planar microwave switches with enough ports to reroute the signals.

SUMMARY OF THE INVENTION

In view of the above problems, the present invention provides a lighter weight microwave switch that has improved uniformity between signal paths, high frequency performance, and physical access.

This is accomplished by configuring the waveguide transmission lines in three dimensions to define a polyhedron and positioning the I/O microwave ports at the corners of the polyhedron. An actuator selectively moves respective reeds in the waveguide transmission lines between a signal-attenuating position abutting the interior surface of the waveguide transmission line and a signal-conducting position substantially coaxial with the waveguide transmission line and abutting signal lines of the I/O microwave ports coupled to opposite ends of the waveguide transmission line.

In a preferred embodiment of a single T-switch, a tetrahedral-shaped conductive cavity is formed with grooves in each of its six edges and coax ports at each of its four corners, each of which point towards the center of the cavity. Coaxial connectors are inserted into the coax ports with their center conductors extended into the opposite ends of the grooves. Conductive reeds are positioned in the respective grooves and conductive members are fastened thereto to define the waveguide transmission lines. In the preferred embodiment, the actuator includes a single 4-pole magnet at the center of the cavity and a motor that rotates the 4-pole magnet between three positions to selectively attract different pairs of reed magnets carried by the reeds in opposing waveguide transmission lines towards the center of the cavity to contact the respective center conductors and repel the remaining four reeds away from the center of the polyhedron against the respective interior surfaces. Alternately, multiple linear, latching actuators could be used to acuate the respective reeds.

In another embodiment, an octahedral cavity provides 6 connectors and 12 paths. Although this embodiment requires an independent actuator for each path, it retains the microwave performance advantages of identical path lengths and configuration, while reducing weight and simplifying the microwave path.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a 3D microwave switch for routing signals in an operating frequency band along selectable signals paths, and particularly for routing signals around failed devices in redundant switching networks on board spacecraft. Each 3D switch includes a plurality of waveguide transmission lines that are spatially configured to define the edges of a polyhedron with a lesser plurality of I/O microwave ports, e.g. coaxially connectors, being positioned at the corners of the polyhedron. Typically, the transmission lines and ports are formed as part of a one-piece conductive cavity but may be connected in a skeletal configuration. An actuator selectively moves conductive reeds inside the waveguide transmission lines between a signal-attenuating position and a signal-conducting position that bridges signal lines of coax ports.

The 3D microwave switch topology facilitates the use of simpler and, in some cases, more central actuating mechanisms than are used in similar planar microwave switches, and thus are lighter weight. In particular, the tetrahedral T-switch discussed in detail below preferably uses a single 3-state 4-pole magnet positioned at the center of the cavity. Furthermore, all of the paths may have equal length, and thus can be designed to exhibit the same microwave properties. In addition, the conductive reeds contact respective signal lines around their circumferences rather than at their ends, and hence the signal lines can have less flare and better high frequency performance. The physical access to the switch is also improved. Lastly, the 3D topology may facilitate new and more complex switch configurations (such as an octahedral switch) that use more than four ports, which will be useful in more complex redundant switching networks.

Figure 1:
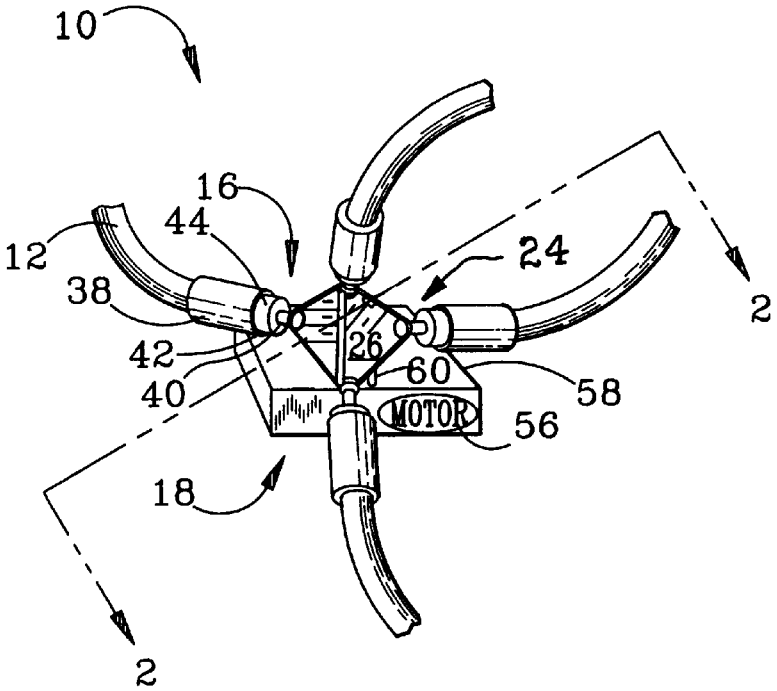
FIG. 1 is a perspective view of a 3D tetrahedral T-switch in accordance with the present invention.
Figure 2:
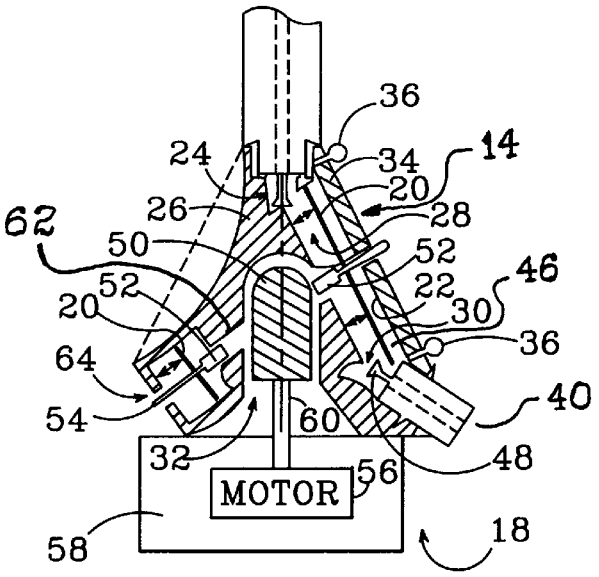
FIG. 2 is a sectional view of the tetrahedral T-switch shown in FIG. 1.
Figure 3:
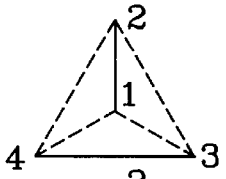
FIG. 3 is a state diagram of the T-switch.
Figure 3:
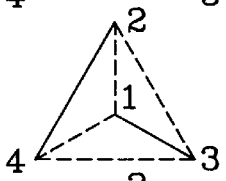
Figure 3:
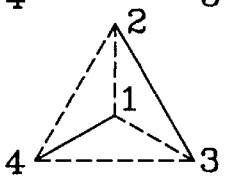

FIGS. 1 and 2 are respectively perspective and sectional views of a T-switch 10 in accordance with the present invention for routing signals in an operating frequency band, suitably 0–18 GHz, between four coaxial cables 12. Six waveguide transmission lines 14 are interconnected in a tetrahedral configuration with four I/O microwave ports 16 positioned at the corners of the tetrahedron so that each port abuts three of the waveguide transmission lines. The waveguide transmission lines are dimensioned to have a cutoff frequency, suitably 45 GHz, greater than the operating frequency band. Actuator 18 selectively moves two pairs of reeds 20 to signal-attenuating positions abutting the interior surfaces 22 of their respective waveguide transmission lines 14 and moves the remaining opposing pair of reeds 20 to a signal-conducting position substantially coaxial with their respective waveguide transmission lines 14 and abutting the ports' signal lines 24 to connect the ports 16 as illustrated in FIG. 3.

In the preferred embodiment, the waveguide transmission lines 14 and I/O microwave ports 16 are formed in a tetrahedral-shaped conductive cavity 26 that is machined to define six grooves 28 along its respective edges, four coax ports 30 in its corners, and an opening 32 in one of its faces. A conductive member 34 is fastened to each groove 28 using, for example, a pair of screws 36 to define the waveguide transmission line 14 around the reed 20. The conductive member 34 provides the interior surface against which the reed 20 is held in the signal-attenuating position.

A coaxial connector 38 is inserted into each coax port 30 with its center conductor 40 extending into the cavity and its outer shield 42 grounded to the cavity to form the I/O microwave port 16. The center conductor 40 and outer shield 42 are separated by an insulative layer 44 and together define the port's signal line 24. In FIG. 1 the outer shield and insulative layer have been cut back to expose the construction of the coaxial connector. The ends 46 of each groove 28 are open to the coax ports 30 at either end of the transmission line so that when the reed is moved to the signal-conducting position it contacts the center conductors 40. The center conductor 40 preferably has a flared end cap 48 whose surface is approximately parallel to the reeds at the point of contact to ensure a good electromechanical contact and to prevent the reed from getting stuck in the signal-conducting position.

The actuator 18 preferably includes a single 4-pole magnet 50 positioned inside an opening 32 at the center of the cavity 26 and a plurality of permanent magnets 52 carried on the respective reeds 20 inside the waveguide transmission lines 14. Each permanent magnet 52 is positioned on a dielectric carrier 54 at the midpoint of its reed 20. A stepper motor 56 inside a housing 58 increments a drive shaft 60 to rotate the 4-pole magnet 50 between three positions so that, in each of the positions, it attracts one pair of opposing permanent magnets 52 and draws them into respective holes 62 formed between grooves 28 and the opening 32 to thereby connect pairs of center conductors 40 with respective conductive reeds 20, and simultaneously, the 4-pole magnet 50 repels two other pair of permanent magnets 52 and pushes their dielectric carriers 54 into respective slots 64 in waveguide transmission lines 14 so that respective reeds 20 are grounded to interior surfaces 22 of respective transmission lines. Alternatively, the actuator may be implemented with multiple linear latching actuators or a 2-pole magnet, which may require the use of springs to return the reed to the signal-attenuating position.

Figure 4A:
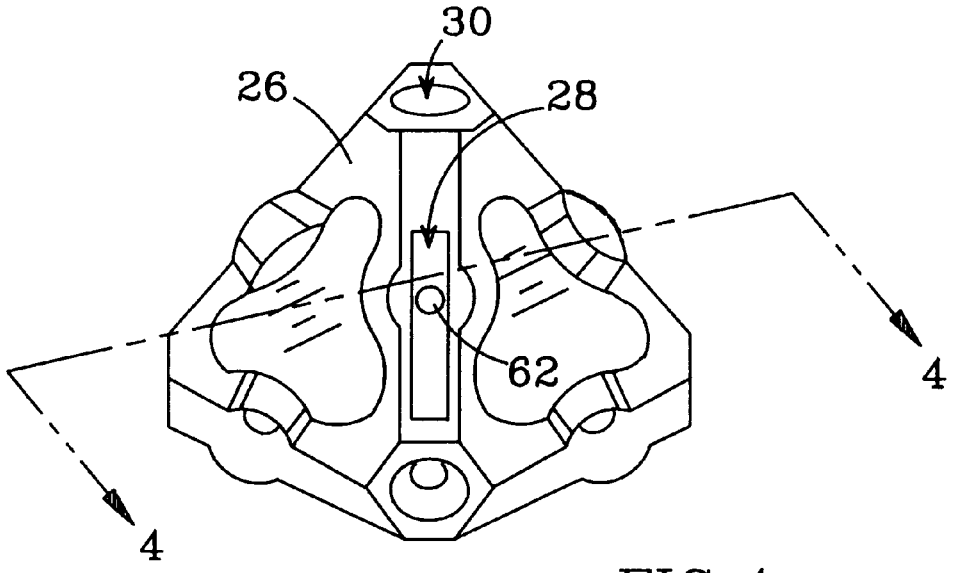
FIGS. 4*a* and 4*b* are respectively a perspective view of a cavity in the T-switch of FIG. 1 and a sectional view along line 4—4 of FIG. 4A.
Figure 4B:
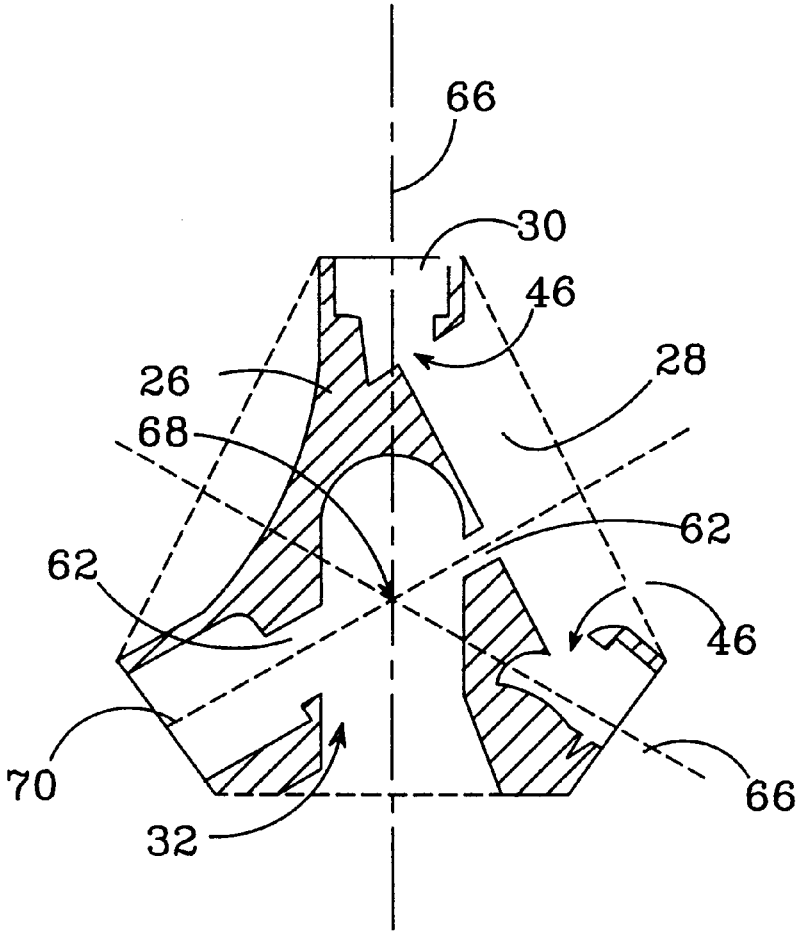

In order to provide signal paths between ports that exhibit the same characteristics over the operating frequency range and to use a single 4-pole magnetic actuator to switch the conductive reeds without supplemental mechanisms such as springs, the microwave switch 10 and particularly the cavity 26 must exhibit a precise symmetry. To maintain uniform microwave characteristics, the waveguide transmission lines 14 must have the same dimensions, e.g. length and cross-section (which is preferably rectangular), and the reeds 20 must contact each port's signal lines 24 at the same angle. As shown in FIGS. 4*a* and 4*b*, this is accomplished in the tetrahedral configuration by aligning the coax ports 30 so that axes 66 which are coaxial with the ports intersect at the center 68 of the cavity and aligning the grooves 28 so that the axes 70 which are normal to the grooves at their midpoints also intersect at the center. This also has the effect of configuring the reeds' permanent magnets (52 in FIG. 2) so that opposing pairs lie on opposite sides of the 4-pole magnet (50 in FIG. 2) directly facing the center of the cavity and, hence the 4-pole magnet. In this configuration, a fairly small single 4-pole magnet is strong enough to move the reeds between their signal-actuating and signal-conducting positions and this configuration reduces the overall weight of the T-switch between 10% and 50% with respect to the known planar 4-port microwave switches.

Although the symmetric configuration is generally preferred, it has a couple of practical drawbacks that may in certain circumstances make a non-symmetric configuration more desirable. For example, in the symmetric configuration as currently implemented the 4-pole magnet can not be withdrawn from the cavity without first removing at least some of the reed structures. This inconvenience can be overcome by turning the three grooves 28 that lie proximate to the opening 32 so that they face directly outward. However, this has two negative effects; the microwave properties of the signal paths are no longer uniform and the reeds' permanent magnets (52 in FIG. 2) do not directly face the 4-pole magnet. As a result, supplemental actuating mechanisms such as springs would need to be added to the actuator, specifically to repel the reeds outward. Furthermore, in the symmetric embodiment, the coaxial cables (12 in FIG. 1) enter the cavity 26 at an angle. If the switch is mounted along a flat surface this may cause the cables to crimp. This problem can be overcome by turning the coax ports 30 that lie proximate to the opening 32 so that they face directly outward. However, this also changes the microwave properties of the signals paths so that they are not uniform.

As further shown in FIGS. 4*a* and 4*b*, the tetrahedral-shaped cavity 26 is preferably machined from a lightweight metal block such as aluminum to form the grooves 28 and their ends 46, coax ports 30, and opening 32. Each groove 28 is formed halfway between the pair of faces that meet at the edge of the tetrahedron. As a result, the normal axes 70 pass through the hole 62 formed in the bottom of the groove, through the center 68 of the cavity, and through the opening 62 formed in the bottom of the opposing groove. Each coax port 30 is formed where faces meet at a corner so that its axis 66 intersects at the center 68 of the cavity. The cavity 26 is machined to form the opening 32 that is perpendicular to a cavity face so that it receives the actuator's multipole magnet and couples to the grooves 28 through respective holes 62.

Figure 5:
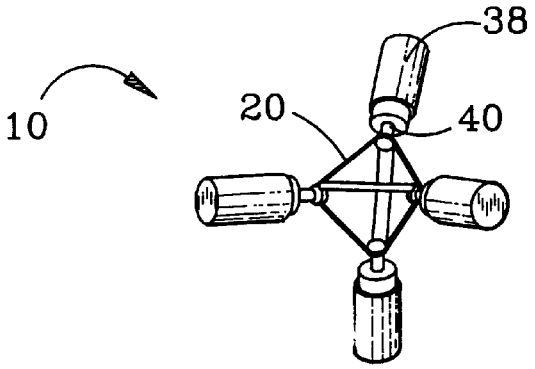
FIG. 5 is an isometric view of the T-switch shown in FIG. 1 illustrating the spatial relationship of the coaxial connectors and conductive reeds.
Figure 6:
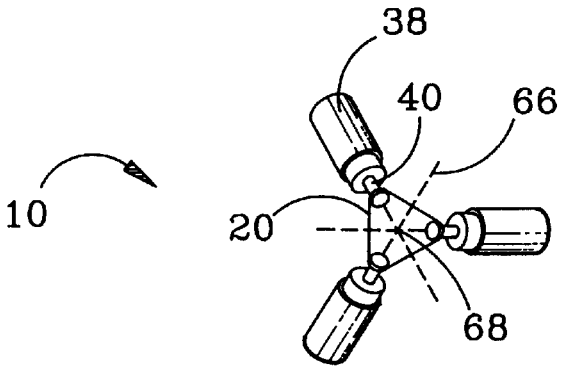
FIG. 6 is a top view of the T-switch shown in FIG. 5.

FIGS. 5 and 6 are respectively isometric and top views of the T-switch 10 showing only the relationship of the reeds 20 and the coaxial connectors 38 in the signal-conducting position. In actual use, only one pair of opposing reeds would be in the signal-conducting position touching the center conductors 40 and the remaining four reeds would be in the signal-attenuation position against the interior surface of the cavity. The center conductors 40 are aligned along respective axis 66 (shown in FIG. 4*b*) that intersect at the center 68 of the cavity. The reeds 20 are equal length and angled so that axes 70 (shown in FIG. 4*b*) normal to their respective midpoints also intersect at the center of the cavity. The reeds are formed from a strong metal that exhibits a good fatigue life such as beryllium-copper.

As a result, each set of three reeds 20 are uniformly spaced around each center conductor 40. Thus, all of the waveguide transmission lines (14 in FIG. 2) have substantially identical microwave properties. Furthermore, the pair of reeds 20 that are moved to the signal-conducting position in any one state lie on opposite sides of the cavity facing its center. Thus, the simple and lightweight 4-pole magnet 50 shown in FIG. 2 can be used to actuate all six reeds simultaneously without having to use supplemental actuating mechanisms such as springs.

Figure 7:
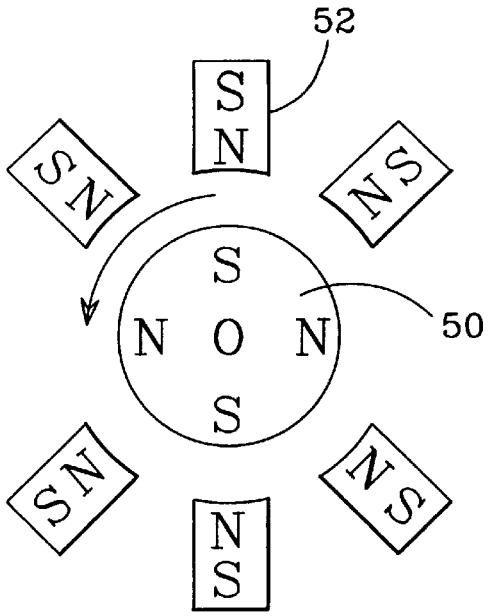
FIG. 7 is a top view of the preferred actuator shown in FIG. 2 illustrating the relationship of the central 3-state 4-pole magnet and the reeds' permanent magnets.

FIG. 7 is a top view of the actuator 18 of FIGS. 1 and 2 showing the spatial relationship of the central 4-pole magnet 50 and the six permanent magnets 52 that are carried on the respective reeds. The permanent magnets are configured so that their north poles all face the 4-pole magnet. The central magnet's two south poles attract a pair of opposing permanent magnets so that their reeds are drawn inwards to the signal-conducting position. The central magnet's two north poles repel the other four permanent magnets so that their reeds are forced outwards into the signal-attenuating position. In this configuration, the permanent magnets themselves tend to repel each other thereby forcing them into the signal-attenuating positions. To switch states as shown in FIG. 3, the permanent magnet 50 is rotated 60° so that its pair of south poles are aligned with the next opposing pair of permanent magnets 52. The resultant states 1, 2 and 3 are shown in FIG. 3 with connected and isolated port pairs respectively shown in solid and broken lines for each state. Because the preferred actuator does not require additional actuating mechanisms, the 3D T-switch is significantly lighter than known planar T-switches and has higher reliability.

Figure 8:
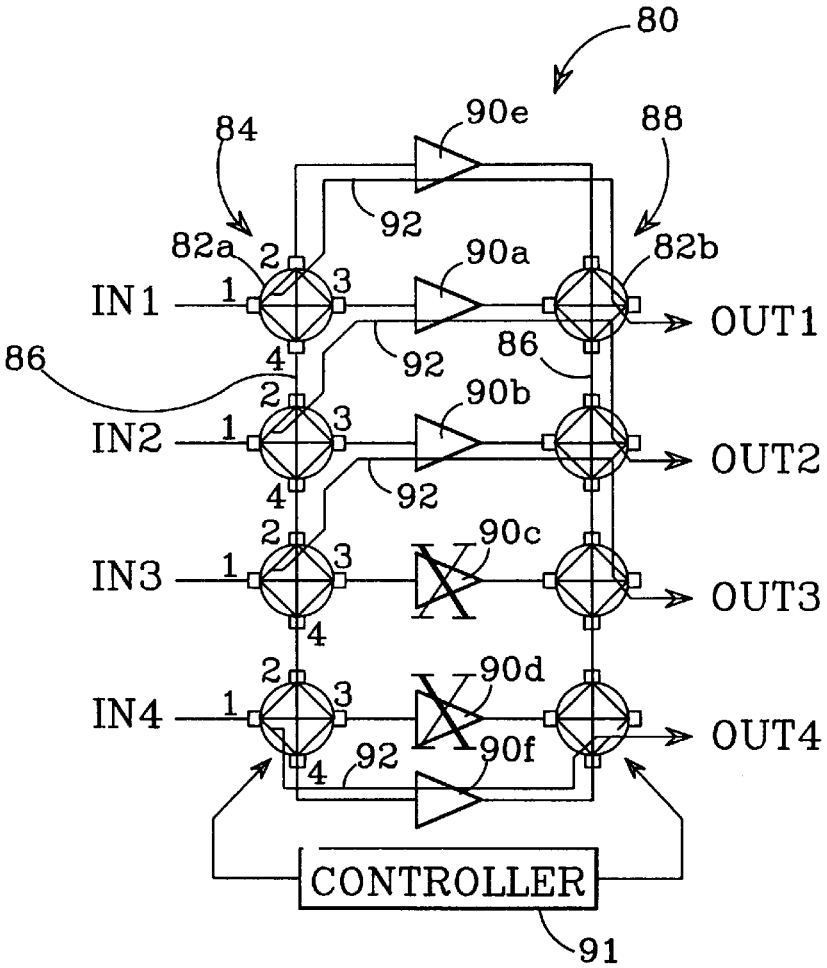
FIG. 8 is a block diagram of a redundant switching network using the 3D switch of the present invention.

FIG. 8 illustrates a redundant switching system 80 in which the T-switches are indicated by the symbol 82. Four of the switches 82 are serially connected to form an input switch set 84. In particular, ports 4 and 2 of adjacent switches are connected with a coaxial cable 86. An output switch set 88 is similarly formed with four switches 82 and three coaxial cables 86.

Primary microwave amplifiers 90*a*–90*d* are coupled between corresponding switches of the input and output switch sets 84 and 88. For example, microwave amplifier 90*a* is coupled between port 3 of switch 82*a* and port 1 of switch 82*b*. In addition, redundant microwave amplifiers 90*e* and 90*f* are coupled between microwave switches at the top and the bottom of the input and output switch sets 84 and 88. For example, redundant amplifier 90*e* is coupled between port 2 of switch 82*a* and port 2 of switch 82*b*.

In normal operation of the switching system 80 (no failures), the switches of the input and output switch sets 84 and 88 are all set to state two of FIG. 3. This provides four signal paths between a group of input ports 1 and a group of output ports 3. Each of these signal paths includes two corresponding switches 82 of the input and output switch sets 84 and 88 and the primary microwave amplifier that is coupled between those switches. No signals are coupled through the redundant amplifiers 90*e* and 90*f*.

The signal paths could be used, for example, in transponder systems of communication satellites. Such systems typically have a plurality of communications channels and must be designed to insure that a predetermined percentage of these channels will be available over the satellite's predicted lifetime. Thus, these systems must be able to substitute redundant components for failed components.

For the switching system 80, this redundancy is illustrated by assuming that primary microwave amplifiers 90*c* and 90*d* have failed (as indicated by a large x over each of these amplifiers). In response, a controller 91 replaces these failed amplifiers with a combination of the remaining primary amplifiers and the redundant amplifiers 90*e* and 90*f*. To do so, the controller 91 places the bottommost switch 82*a* in the third state of FIG. 3 and all other switches of the input switch set 84 in the first state. At the same time, the bottommost switch 82*b* is placed in the first state and all other switches of the output switch set 88 are placed in the third state. Thus, the amplifier paths are altered to the paths 92 so that primary amplifiers 90*a* and 90*b* and redundant amplifiers 90*e* and 90*f* continue to provide signal paths between the group of input ports 1 and the group of output ports 3.

Figure 9:
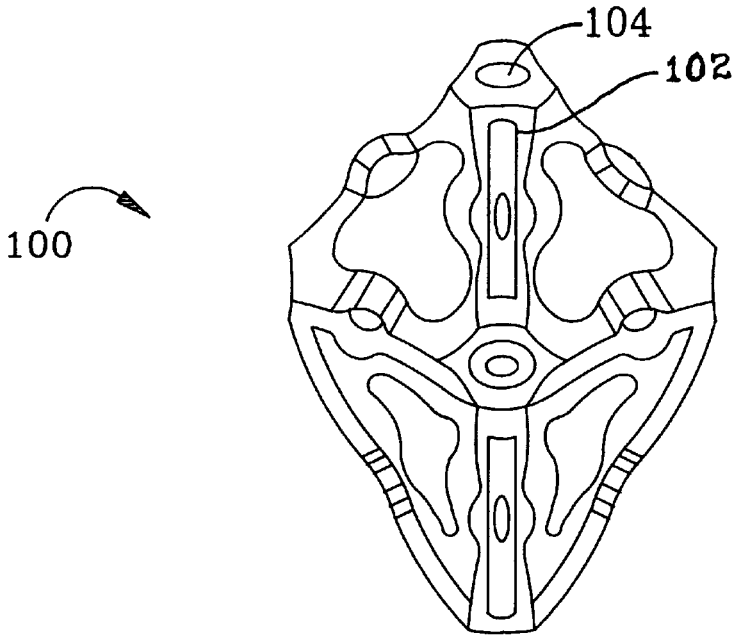
FIG. 9 is a perspective view of an octahedral cavity.

FIG. 9 is a perspective view of an octahedral cavity 100 for use in a redundant microwave switch. The octahedral cavity is preferably machined from a lightweight metal block such as aluminum with grooves 102 that lie along each of its twelve equal length edges and coax ports 104 that lie at each of its eight corners. Each groove 102 is formed at an angle halfway between adjacent octahedral faces. Each coax port 104 points directly towards the center of the cavity.

Figure 10:
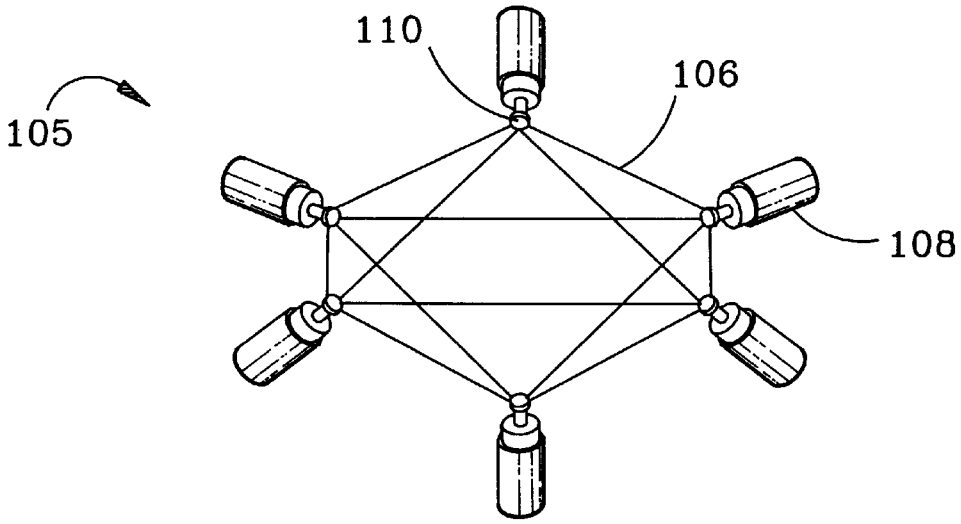
FIG. 10 is an isometric view of an octahedral T-switch illustrating the spatial relationship of the coaxial connecters conductive reeds.

FIG. 10 is an isometric view of a redundant microwave switch 105 showing only the relationship of reeds 106 and coaxial connecters 108 in the signal-conducting position. In actual use, selected ones of the reeds would be in the signal conducting position touching the center conductors 110 and the remaining reeds would be in the signal-attenuating position against the interior surface of the cavity 100 shown in FIG. 9. Center conductors 110 are aligned so that their respective axis intersect at the center of the cavity. The reeds 106 are angled so that all of the center conductors 110 have the same angle with respect to all of the reeds 106 that they contact, all of the waveguide transmission lines have substantially the same length and cross section, and all the reeds have substantially the same length. As a result, the signal paths between any two of the coaxial connecters 108 have the same microwave properties in the operating frequency band.

Figure 11B:
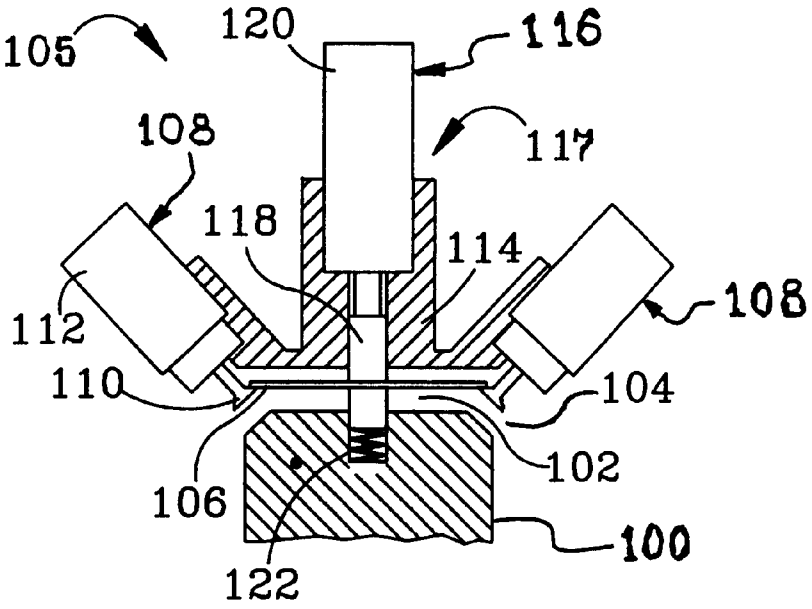
FIGS. 11*a* and 11*b* are sectional views of the octahedral T-switch illustrating independent actuators in open and closed positions respectively.
Figure 11A:
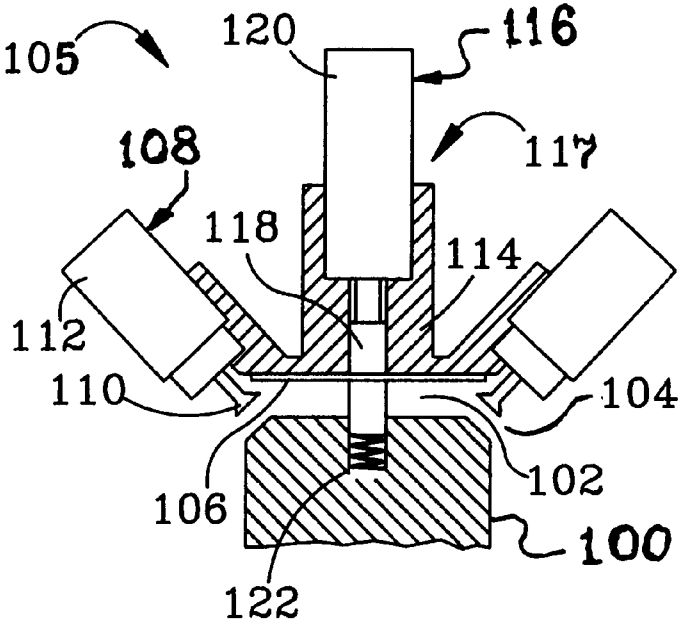

FIGS. 11*a* and 11*b* are respectively sectional views of the microwave switch 105 of FIG. 10 in the signal-attenuating and signal-conducting positions. The 6 coaxial connecters 108 are inserted into the different coax ports 104 with their center conductors 110 extending through the open ends of the grooves 102 so that they are angled inward at opposite ends of each groove. Each coax connector also includes an outer conductor 112 coaxially arranged with the center conductor 110 and contacted to the cavity 100 to form a signal line. A reed 106 is positioned in each groove 102 and a conductive member 114 is fastened to the groove to define the waveguide transmission line that is coupled between a pair of the coaxial connectors and to define an actuator port 117. Each of the waveguide transmission lines is dimensioned to have a cutoff frequency greater than the operating frequency band.

A plurality of independent actuators 116 are received in respective ports 117 and selectively move the respective reeds 106 between signal-attenuating positions abutting the interior surface of their respective waveguide transmission lines and a signal-conducting position substantially coaxial with their respective waveguide transmission lines and abutted between the center conductors 110 of the coaxial connectors at opposite ends of the waveguide transmission line. Each actuator 116 suitably includes a dielectric stub 118 that is carried by each reed 106 at its mid-point and extends perpendicular to the reed on both sides. A latching solenoid 120 positioned in the actuator port exerts a force on the stub 118 that moves the reed to its signal-conducting position as shown in FIG. 11*b*. This compresses a return spring 122 on the other side of the reed such that when the solenoid is deactivated the return spring forces the reed to its signal-attenuating position as shown in FIG. 11*a*.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A three dimensional (3D) microwave switch for routing signals in an operating frequency band along selectable signals paths between a plurality of switch ports, comprising:

a plurality of I/O microwave ports having respective signal lines;

a plurality of waveguide transmission lines that are coupled between respective pairs of said I/O microwave ports, each said waveguide transmission line having an interior surface and dimensioned to have a cutoff frequency greater than said operating frequency band, said waveguide transmission lines being spatially configured in three dimensions to define a polyhedron with the I/O microwave ports positioned at the corners of said polyhedron;

a plurality of conductive reeds that are positioned in respective ones of said waveguide transmission lines; and an actuator that selectively moves each said reed between a signal-attenuating position abutting the interior surface of its respective waveguide transmission line and a signal-conducting position substantially coaxial with its respective waveguide transmission line and abutting the signal lines of the I/O microwave ports coupled to opposite ends of its respective waveguide transmission line.

2. A three dimensional (3D) microwave switch for routing signals in an operating frequency band along selectable signals paths between a plurality of switch ports, comprising:

a plurality of I/O microwave ports having respective signal lines;

a plurality of waveguide transmission lines that are coupled between respective pairs of said I/O microwave ports, each said waveguide transmission line having an interior surface and dimensioned to have a cutoff frequency greater than said operating frequency band, said waveguide transmission lines being spatially configured in three dimensions to define a polyhedron with the I/O microwave ports positioned at the corners of said polyhedron;

a plurality of conductive reeds that are positioned in respective ones of said waveguide transmission lines; and an actuator that selectively moves each said reed between a signal-attenuating position abutting the interior surface of its respective waveguide transmission line and a signal-conducting position substantially coaxial with its respective waveguide transmission line and abutting the signal lines of the I/O microwave ports coupled to opposite ends of its respective waveguide transmission line;

wherein said I/O microwave ports' signal lines point toward the center of the polyhedron so that they are angled inward at opposite ends of each said waveguide transmission line and away from the interior surfaces, said actuator switching each said reed into said signal-conducting position by moving it toward the center of the polyhedron so that the reed is contacted between the opposing signal lines and moving each said reed into said signal-attenuating position by moving it away from the center of the polyhedron against the interior surface.

3. The 3D microwave switch of claim 2, wherein each said I/O microwave port's signal line has a flared end cap whose surface at the point of contact is approximately parallel to the reeds.

4. The 3D microwave switch of claim 2, further comprising:

a one-piece polyhedral-shaped conductive cavity having a) a plurality of faces, b) a plurality of edges that are each formed with a groove having a pair of open ends, and c) a plurality of corners that are each formed with a coax port that provides access to the open ends of the grooves that abut said coax port;

a plurality of conductive members that are fastened to the different grooves to form the waveguide transmission lines; and a plurality of coaxial connectors that are inserted into the different coax ports to form the I/O microwave ports, each said coaxial connector having a center conductor that extends through the opening in the coax port into the open ends of said grooves and an outer conductor coaxially arranged with said center conductor and contacted to said cavity to form said signal line.

5. The 3D microwave switch of claim 2, wherein all of said signal lines have the same angle with respect to all of the reeds they contact, all of said waveguide transmission lines have substantially the same length and cross-section, and all of said reeds have substantially the same length so that the signal paths between any two of said I/O microwave ports have substantially the same microwave properties in said operating frequency band.

6. The 3D microwave switch of claim 5, wherein said polyhedron has a tetrahedral shape with six waveguide transmission lines being coupled between four coaxial connectors.

7. The 3D microwave switch of claim 6, wherein said polyhedron has four faces that intersect at said waveguide transmission lines, each said waveguide transmission line having an opening to the center of the tetrahedrally shaped polyhedron, said actuator comprising:

a reed magnet carried by each said reed at its midpoint and positioned in the waveguide transmission line's opening to point towards the center of the polyhedron with the same polarity;

one 4-pole magnet positioned at the center of the polyhedron; and a motor that rotates the 4-pole magnet between three positions to selectively attract different pairs of said reeds in opposing waveguide transmission lines towards the center of the cavity to contact the signal lines and repel the remaining four reeds away from the center of the polyhedron against the respective interior surfaces.

8. The 3D microwave switch of claim 5, wherein said polyhedron has an octahedral shape with twelve waveguide transmission lines coupled between six coaxial connectors, said actuator comprising a plurality of mechanisms that independently actuate the respective reeds.

9. A three dimensional (3D) microwave switch for routing signals in an operating frequency band along selectable signal paths between a plurality of switch ports, comprising:

a polyhedral-shaped cavity having a) a plurality of faces, b) a plurality of edges that are each formed with a groove having a pair of open ends, and c) a plurality of corners that are each formed with a coax port that provides access to the open ends of the grooves that abut said coax port;

a plurality of coaxial connectors that are inserted into the different coax ports, each said coaxial connector having a center conductor that extends through the coax port into the open ends of said grooves and an outer conductor coaxially arranged with said center conductor and contacted to said cavity to form a signal line;

a plurality of conductive reeds that are positioned in respective ones of said grooves;

a plurality of conductive members that are fastened to the different grooves to define a plurality of waveguide transmission lines that are coupled between respective pairs of said coaxial connectors, each said waveguide transmission line having an interior surface and dimensioned to have a cutoff frequency greater than said operating frequency band, said waveguide transmission lines thereby being spatially positioned in three dimensions along the edges of said cavity with said coaxial connectors positioned at the corners of said cavity; and an actuator that selectively moves each said reed between a signal-attenuating position abutting the interior surface of the waveguide transmission line and a signal-conducting position substantially coaxial with the waveguide transmission line and abutting the center conductors of the coaxial connectors coupled to opposite ends of the waveguide transmission line.

10. A three dimensional (3D) microwave switch for routing signals in an operating frequency band along selectable signal paths between a plurality of switch ports, comprising:

a polyhedral-shaped cavity having a) a plurality of faces, b) a plurality of edges that are each formed with a groove having a pair of open ends, and c) a plurality of corners that are each formed with a coax port that provides access to the open ends of the grooves that abut said coax port;

a plurality of coaxial connectors that are inserted into the different coax ports, each said coaxial connector having a center conductor that extends through the coax port into the open ends of said grooves and an outer conductor coaxially arranged with said center conductor and contacted to said cavity to form a signal line;

a plurality of conductive reeds that are positioned in respective ones of said grooves;

a plurality of conductive members that are fastened to the different grooves to define a plurality of waveguide transmission lines that are coupled between respective pairs of said coaxial connectors, each said waveguide transmission line having an interior surface and dimensioned to have a cutoff frequency greater than said operating frequency band; and an actuator that selectively moves each said reed between a signal-attenuating position abutting the interior surface of the waveguide transmission line and a signal-conducting position substantially coaxial with the waveguide transmission line and abutting the center conductors of the coaxial connectors coupled to opposite ends of the waveguide transmission line;

wherein said coaxial connectors' center conductors point toward the center of the cavity so that they are angled inward at opposite ends of each said waveguide transmission line and away from the interior surfaces, said actuator switching each said reed into said signal-conducting position by moving it towards the center of the cavity so that the reed is contacted between the opposing center conductors and switching each said reed into said signal-attenuating position by moving it away from the center of the cavity against the interior surface.

11. The 3D microwave switch of claim 10, wherein each said coaxial connector's center conductor has a flared end cap whose surface is approximately parallel to the reeds it contacts at the point of contact.

12. The 3D microwave switch of claim 10, wherein all of said center conductors have the same angle with respect to all of the reeds they contact, all of said waveguide transmission lines have substantially the same length and cross-section, and all of said reeds have substantially the same length so that the signal paths between any two of said coaxial connectors have substantially the same microwave properties in said operating frequency band.

13. The 3D microwave switch of claim 12, wherein said cavity has a tetrahedral shape with six waveguide transmission lines being coupled between four coaxial connectors.

14. The 3D microwave switch of claim 13, wherein each pair of faces meet at said groove, and each groove has an opening to the center of the cavity, said actuator comprising:

a reed magnet carried by each said reed at its midpoint and positioned in the groove's opening to point towards the center of the cavity with the same polarity;

one 4-pole magnet positioned at the center of the cavity; and a motor that rotates the 4-pole magnet between three positions to selectively attract different pairs of said reeds in opposing waveguide transmission lines towards the center of the cavity to contact the center conductors and repel the remaining four reeds away from the center of the polygon against the respective interior surfaces.

15. The 3D microwave switch of claim 14, wherein each said coaxial connector's center conductor has a flared end cap whose surface is approximately parallel to the reeds it contacts at the point of contact.

16. The 3D microwave switch of claim 12, wherein said cavity has an octahedral shape with twelve waveguide transmission lines coupled between six coaxial connectors, said actuator comprising a plurality of mechanisms that independently actuate the respective reeds.

17. A three dimensional (3D) microwave T-switch for routing signals in an operating frequency band along three different pairs of signals paths between four switch ports, comprising:

a tetrahedral-shaped conductive cavity having a) four faces, at least one of which is open, b) six edges that are each formed with a groove having a pair of open ends, and c) four corners that are each formed with a coax port that provides access to the open ends of the grooves that abut said coax port;

four coaxial connectors that are inserted into the different coax ports, each said coaxial connector having a center conductor that extends through the coax port into the open ends of said grooves so that they are angled inward at opposite ends of each said groove and an outer conductor coaxially arranged with said center conductor and contacted to said cavity to form a signal line;

six conductive reeds that are positioned in respective ones of said grooves;

six conductive members that are fastened to the different grooves to define six waveguide transmission lines that are coupled between respective pairs of said coaxial connectors, each said waveguide transmission line having an interior surface and dimensioned to have a cutoff frequency greater than said operating frequency band; and an actuator positioned inside the cavity that selectively moves two opposing pairs of said reeds to signal-attenuating positions abutting the interior surface of their respective waveguide transmission lines and moves the other opposing pair of said reeds to a signal-conducting position substantially coaxial with their respective waveguide transmission lines and in contact with the center conductors of the coaxial connectors that are coupled to opposite ends of their waveguide transmission lines.

18. The 3D microwave T-switch of claim 17, wherein all of said center conductors have the same angle with respect to all of the reeds they contact, all of said waveguide transmission lines have substantially the same length and cross-section, and all of said reeds have substantially the same length so that the signal paths between any two of said coaxial connectors have substantially the same microwave properties in said operating frequency band.

19. The 3D microwave T-switch of claim 18, wherein each said groove is formed halfway between the pair of faces that meet at said groove and has an opening to the center of the cavity, said actuator comprising:

a reed magnet carried by each said reed at its midpoint and positioned in the groove's opening to point towards the center of the cavity with the same polarity;

one 4-pole magnet positioned at the center of the cavity; and a motor that rotates the 4-pole magnet between three positions to selectively attract different pairs of said reeds in opposing waveguide transmission lines towards the center of the cavity to contact the respective center conductors and repel the remaining four reeds away from the center of the polygon against the respective interior surfaces.

20. The 3D microwave T-switch of claim 19, wherein each said coaxial connector's center conductor has a flared end cap whose surface is approximately parallel to the reeds it contacts at the point of contact.

21. A redundant amplifier system, comprising:

m serial-connected 3D input T-switches having respective input ports for receiving m input signals, serial ports for interconnecting the T-switches to direct the input signals to m of n output ports where n>m;

n amplifiers that are coupled to the respective output ports;

m serial-connected 3D output T-switches having n input ports that are coupled to the respective amplifiers, serial ports for interconnecting the T-switches to direct the amplified input signals to m output ports, each said input and output T-switches including:

a tetrahedral-shaped conductive cavity having a) four faces, b) six edges that are each formed with a groove having a pair of open ends, and c) four corners that are each formed with a port that provides access to the open ends of the grooves that abut said port;

four coaxial connectors that are inserted into the different ports to provide the different input, serial, and output ports, each said coaxial connector having a center conductor that extends through the port into the open ends of said grooves so that they are angled inward at opposite ends of each said groove and an outer conductor coaxially arranged with said center conductor and contacted to said cavity to form a signal line;

six conductive reeds that are positioned in respective ones of said grooves;

six conductive members that are fastened to the different grooves to define six waveguide transmission lines that are coupled between respective pairs of said coaxial connectors, each said waveguide transmission line having an interior surface and dimensioned to have a cutoff frequency greater than said operating frequency band; and an actuator that selectively moves two opposing pairs of said reeds to signal-attenuating positions abutting the interior surface of their respective waveguide transmission lines and moves the other opposing pair of said reeds to a signal-conducting position substantially coaxial with their respective waveguide transmission lines and contacted between the center conductors of the coaxial connectors that are coupled to opposite ends of their waveguide transmission lines; and a controller that senses when up to n-m of said amplifiers fail and causes the actuators to move selected opposing pairs of said reeds between their signal-attenuating and signal-conducting positions to direct the m input signals to m of said amplifiers that have not failed and to direct the amplified input signals to the m output ports.

22. The redundant amplifier system of claim 21, wherein all of said center conductors have the same angle with respect to all of the reeds they contact, all of said waveguide transmission lines have substantially the same length and cross-section, and all of said reeds have substantially the same length so that the signal paths between any two of said coaxial connectors have substantially the same microwave properties in said operating frequency band.

23. The redundant amplifier system of claim 22, wherein each said groove is formed halfway between the pair of faces that meet at said groove and has an opening to the center of the cavity, said actuator comprising:

a reed magnet carried by each said reed at its midpoint and positioned in the groove's opening to point towards the center of the cavity with the same polarity;

one 4-pole magnet positioned at the center of the cavity; and a motor that rotates the 4-pole magnet between three positions to selectively attract different pairs of said reeds in opposing waveguide transmission lines towards the center of the cavity to contact the respective center conductors and repel the remaining four reeds away from the center of the polygon against the respective interior surfaces.

24. The redundant amplifier system of claim 23, wherein each said coaxial connector's center conductor has a flared end cap whose surface is approximately parallel to the reeds it contacts at the point of contact.

25. A three dimensional (3D) microwave switch for routing signals in an operating frequency band along twelve signals paths between six switch ports, comprising:

a octahedral-shaped conductive cavity having a) eight faces, b) twelve edges that are each formed with a groove having a pair of open ends, and c) six corners that are each formed with a coax port that provides access to the open ends of the grooves that abut said coax port;

six coaxial connectors that are inserted into the different coax ports, each said coaxial connector having a center conductor that extends through the coax port into the open ends of said grooves so that they are angled inward at opposite ends of each said groove and an outer conductor coaxially arranged with said center conductor and contacted to said cavity to form a signal line;

twelve conductive reeds that are positioned in respective ones of said grooves;

twelve conductive members that are fastened to the different grooves to define twelve waveguide transmission lines that are coupled between respective pairs of said coaxial connectors, each said waveguide transmission line having an interior surface and dimensioned to have a cutoff frequency greater than said operating frequency band; and an actuator that selectively moves said reeds to signal-attenuating positions abutting the interior surface of their respective waveguide transmission lines and moves the remaining reeds to a signal-conducting position substantially coaxial with their respective waveguide transmission lines and contacted between the center conductors of the coaxial connectors that are coupled to opposite ends of their waveguide transmission lines.

26. The 3D microwave switch of claim 25, wherein all of said center conductors have the same angle with respect to all of the reeds they contact, all of said waveguide transmission lines have substantially the same length and cross-section, and all of said reeds have substantially the same length so that the signal paths between any two of said coaxial connectors have substantially the same microwave properties in said operating frequency band.

27. The 3D microwave switch of claim 25, wherein said actuator comprises a different actuating mechanism for each said reed.

* * * * *